US005120233A

United States Patent [19]

Mikola

[11] Patent Number: 5,120,233

[45] Date of Patent: * Jun. 9, 1992

[54] RETAINING MECHANISM FOR SECURING A LAMP BASE WITH A SOCKET

[75] Inventor: James A. Mikola, Livonia, Mich.

[73] Assignee: Ford Motor Company, Dearborn, Mich.

[ * ] Notice: The portion of the term of this patent subsequent to Mar. 3, 2004 has been disclaimed.

[21] Appl. No.: 630,415

[22] Filed: Dec. 19, 1990

Related U.S. Application Data

[63] Continuation of Ser. No. 95,966, Dec. 3, 1987, abandoned, which is a continuation of Ser. No. 864,636, Jun. 30, 1986, abandoned, which is a continuation of Ser. No. 682,455, Dec. 17, 1984, Pat. No. 4,647,132.

[51] Int. Cl.[5] ..... H01R 13/627

[52] U.S. Cl. ..... 439/356; 439/349; 439/619

[58] Field of Search ..... 439/350-357, 439/348, 349, 611, 619, 699, 345, 347; 313/318

[56] References Cited

U.S. PATENT DOCUMENTS

| | | | |
|---|---|---|---|
| 2,619,515 | 11/1952 | Doane | 339/91 R |
| 2,786,189 | 3/1957 | Sargis | 339/91 L |
| 3,256,508 | 6/1966 | Malm | 339/144 |
| 3,609,641 | 9/1971 | Luce et al. | 339/93 |
| 3,676,834 | 7/1972 | Kaldor et al. | 339/59 L |
| 3,702,455 | 11/1972 | Raynor et al. | 339/17 C |
| 3,777,137 | 12/1973 | Costanzo et al. | 339/176 L |
| 3,781,755 | 12/1973 | Pitacco | 339/176 L |
| 3,783,437 | 1/1974 | Graff et al. | 339/176 L |
| 3,950,061 | 4/1976 | Kausen | 339/93 L |
| 3,979,627 | 9/1976 | Leadvaro et al. | 339/144 R |
| 4,028,577 | 6/1977 | Gates et al. | 339/144 R |
| 4,114,972 | 9/1978 | Kraus et al. | 339/65 |
| 4,603,278 | 7/1986 | Devir et al. | 339/145 R |
| 4,647,132 | 3/1987 | Mikola | 439/345 |

FOREIGN PATENT DOCUMENTS

| | | | |
|---|---|---|---|
| 1326018 | 8/1973 | United Kingdom | 339/176 L |

OTHER PUBLICATIONS

Ford 1985 Car Shop Manual—Tempo/Topaz, Escrot/-Lynx, EXP. Section 32-20, pp. 1-10—Lamps—Parking, Rear and Marker.

*Primary Examiner*—David L. Pirlot

*Attorney, Agent, or Firm*—Paul K. Godwin, Jr.; Roger L. May

[57] ABSTRACT

A retaining mechanism, within a lamp socket, includes a single wire spring element mounted external to the lamp socket and protrudes into the lamp socket opening so as to provide insertion interference to ramped projections extending from either end of a lamp wedge base element and frictional retention against the ramped projections when the wedge base element is fully inserted.

4 Claims, 3 Drawing Sheets

RETAINING MECHANISM FOR SECURING A LAMP BASE WITH A SOCKET

This is a continuation of copending application Ser. No. 07/095,966 filed on Dec. 3, 1987 now abandoned which is a continuation of Ser. No. 06/864,636, filed Jun. 30, 1986, now abandoned, which was a continuation of Ser. No. 06/682,455, filed Dec. 17, 1984, now U.S. Pat. No. 4,647,132.

BACKGROUND OF THE INVENTION

1. Field of the Invention

The present invention is directed to the field of automotive lamp and socket assemblies and more specifically to the area of an improved retaining mechanism used in conjunction with an improved lamp base to secure a lamp within a socket.

2. Description of the Prior Art

Prior art wedge base lamp bulbs and sockets are disclosed in several patents. For instance, U.S. Pat. No. 4,114,972 discloses a socket which is used to support and retain a single filament wedge base bulb. The socket is shown as employing asymmetrical flexible ribs formed with partially cylindrical surfaces to mate and resiliently grip vertical ribs on the sealed base of the bulb envelope. The asymmetry of the gripping ribs causes the inserted base of the bulb to be slightly rotated in a counterclockwise direction in order to force the exposed filament wire leads into electrical contact with the socket contact elements.

U.S. Pat. No. 3,676,834 discloses a structure for mounting and electrically connecting a wedge base type lamp bulb in a resilient socket, wherein the bulb is gripped above its base on the envelope portion.

U S. Pat. No. 3,950,061 also discloses a socket for a wedge base lamp bulb. In that patent, the socket contains a recessed seat in which the enlarged cylindrical envelope of the bulb is engaged. The seat limits the downward movement of the lamp bulb in the socket, while a pair of opposed flexible resilient ribs within the recessed seat of the socket compressibly engage the envelope and hold the lamp in place.

In several of the prior art structures, there is a lack of positive retention. As such, severe vibration or thermal cycling may cause the lamps to come loose from the sockets. Therefore, in automotive external lighting applications, prior art wedge base lamps have not been deemed to be suitable alternatives to conventional bayonet lamp bulbs.

A conventional bayonet lamp bulb is usually formed as a glass envelope cemented into a cylindrical metal lamp base with its ground filament leads commonly soldered to the base and its other filament leads soldered to individual terminals at the insulated bottom of the base. Bayonet lamp sockets are such that the lamp bulbs must be properly aligned, inserted and rotated against an outwardly biased set of contact terminals. However, corrosion of the biasing springs and terminals often causes the removal of the lamp bulbs to be difficult. In addition, the construction of such lamp bulbs requires more steps to fabricate then the wedge type bulbs, that have been found to be desirable substitutes in other applications.

SUMMARY OF THE INVENTION

The present invention is directed to a positive retention mechanism within a socket that interacts with a unique base element attached to a wedge base type bulb. The retention mechanism utilizes a generally rectangular "C" shaped spring wire that intrudes into the interior of the socket so as to provide some interference to insertion of the lamp base into the socket and positive frictional retention of the base in the socket. The wedge base is provided with ramped projection surfaces that provide a low resistance camming action to the spring wire when the lamp base is inserted into the socket, and a high resistance to removal, once the base is fully inserted into the socket.

The main advantage of utilizing a wedge base lamp bulb in automotive exterior lighting applications is manufacturing costs accompanied by the reduction in assembly time due to the symmetrical nature of the base element and socket, Which eliminates criticality of base orientation when the lamp is mated with its socket.

It is, therefore, an object of the present invention to provide a positive retention mechanism for a wedge base lamp bulb socket.

It is another object of the present invention to provide a novel wedge base element with symmetrically positioned ramped projections for interacting with the socket retention mechanism to achieve relatively low frictional resistance to insertion into and relatively high frictional resistance to removal from the socket.

DETAILED DESCRIPTION OF THE PREFERRED EMBODIMENT

Figure 1A:
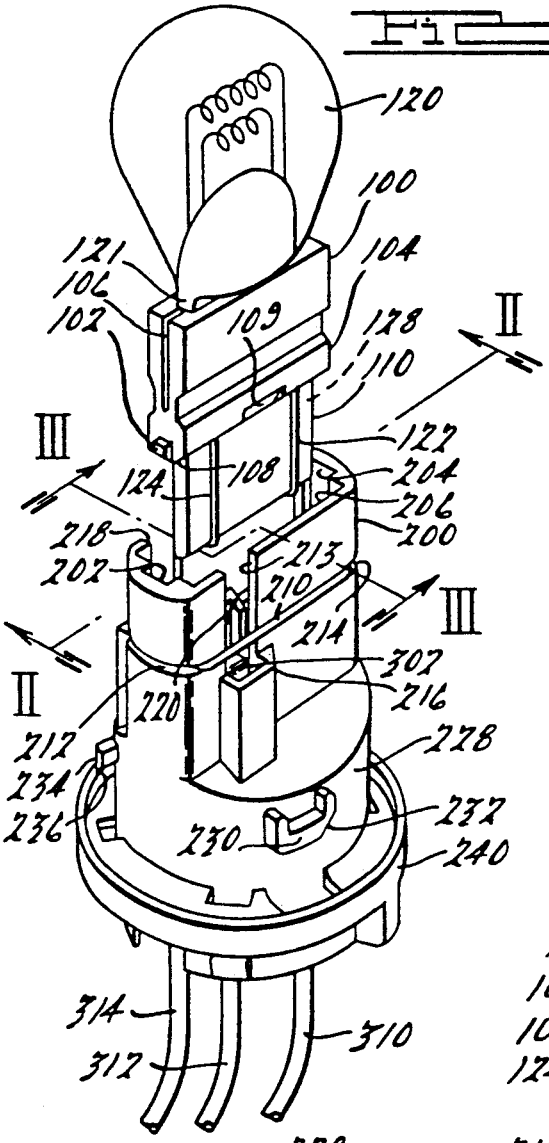
FIG. 1A is a partially exploded perspective view of the present invention.
Figure 1B:
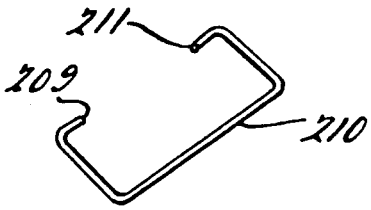
FIG. 1B is a detailed perspective view of the retaining spring shown in FIG. 1A.
Figure 1C:
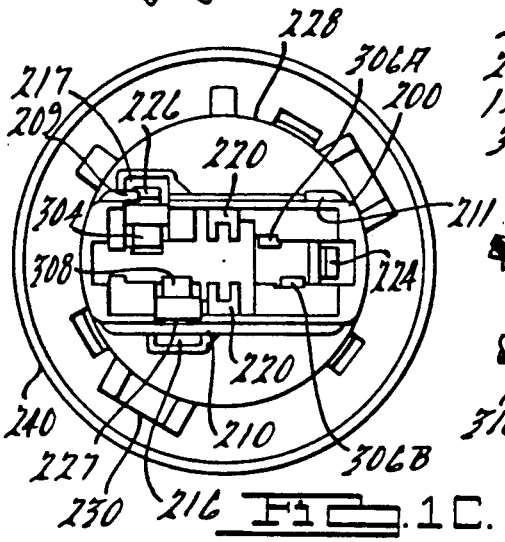
FIG. 1C is a detailed top view of the socket shown in FIG. 1A.
Figure 2:
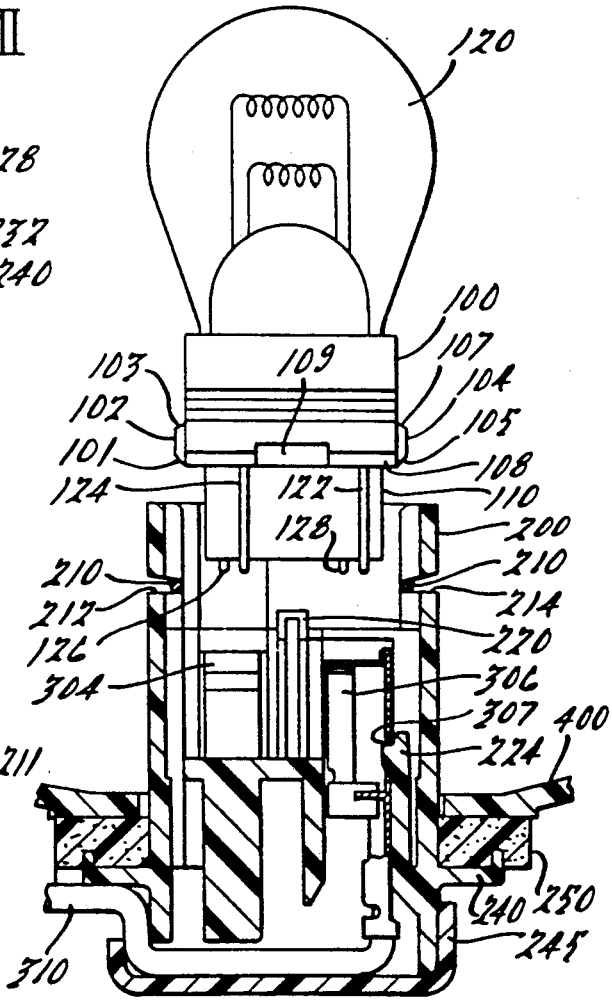
FIG. 2 is an elevational cross-section of the present invention taken along section lines II—II of FIG. 1A.
Figure 4:
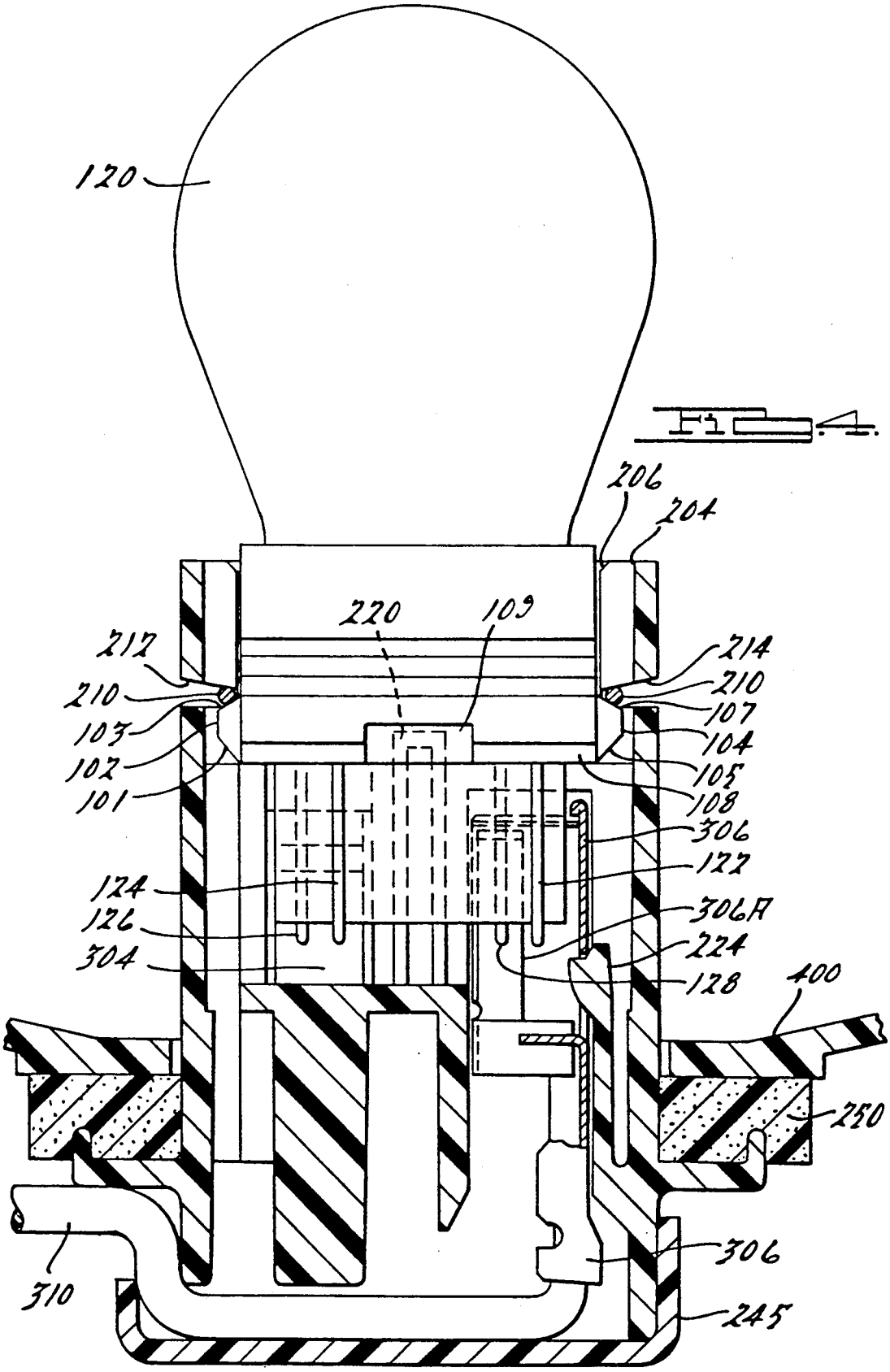
FIG. 4 is an elevational cross-section of the socket shown in FIG. 2 with the lamp base presented as being fully inserted and retained in the socket.
Figure 3:
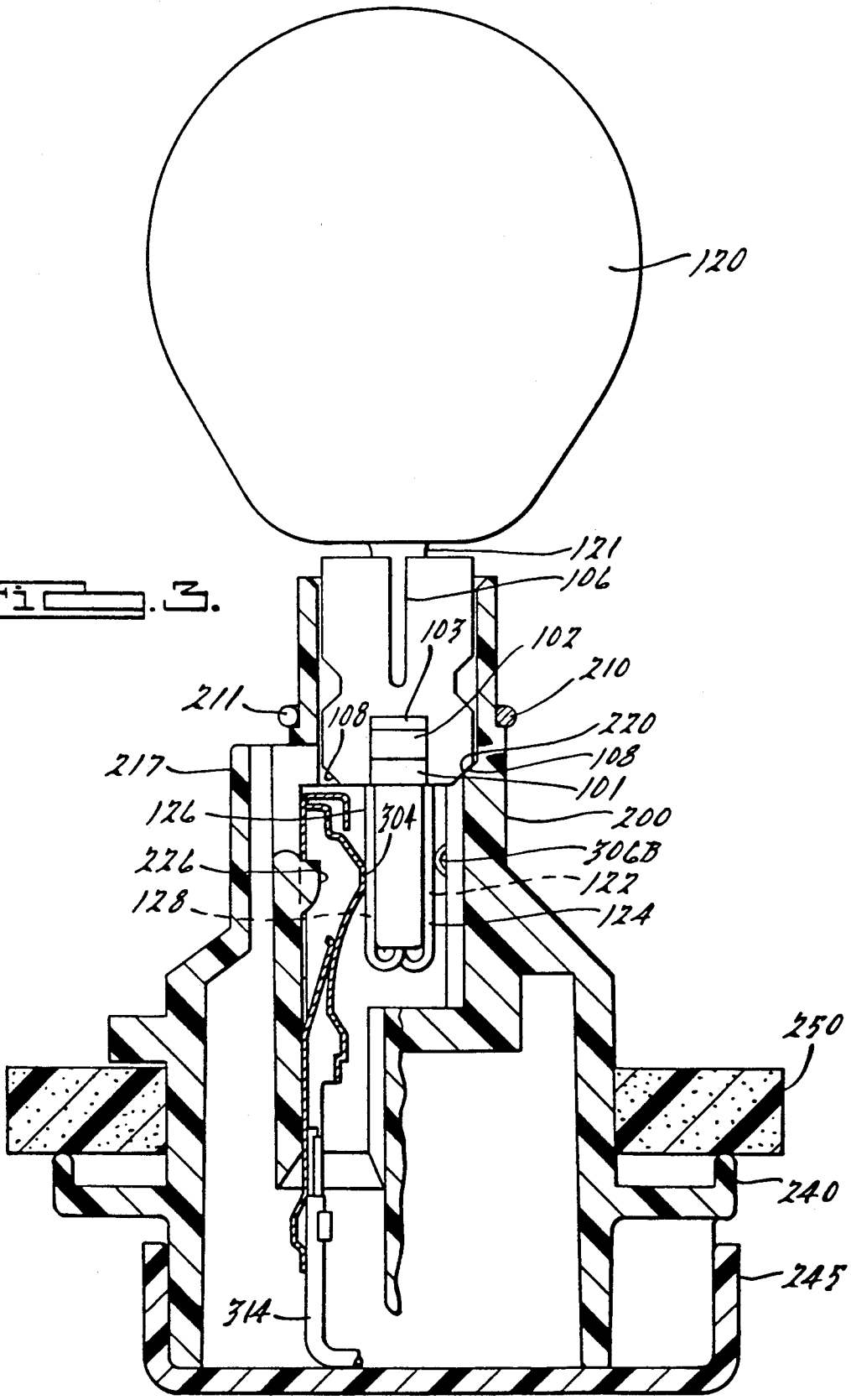
FIG. 3 is an elevational cross-section of the socket shown in FIG. 1A taken along section lines III—III, with the lamp base presented as being fully inserted and retained in the socket.

A single embodiment of the invention is shown in the figures as being incorporated into a socket 200 configured to retain the wedge base element 100 of a lamp 120.

The lamp 120 shown in the drawings is a dual filament type having four filament lead wires extending through the sealed envelope base portion 121.

The wedge base element 100 is formed of a molded insulative material, such as nylon, and has an upper portion having a generally rectangular parallelopiped shape with its length dimension being the major dimension along the sealed base envelope portion of the lamp, its height dimension being a submajor dimension and its width dimension being the most minor dimension. The upper portion is configured to compressively grip and retain the sealed envelope base portion 121 of the lamp 120. The upper portion of the wedge base 100 defines an opening 106 running along its length that extends vertically from the top between opposing sides. The opposing sides provide compressive holding forces to the inserted sealed envelope base portion 121. The wedge base element 100 also includes a bottom portion 110 which extends from and is integral with the upper portion 100. The bottom portion 110 includes internally formed vertical apertures (parallel to the height dimension) through which the filament lead wires 122, 124, 126 and 28 extend from the lamp 120. The filament lead wires are individually bent in opposing directions so as to extend vertically along the opposite outer surfaces of the bottom portion 110.

The upper portion of the wedge base 100 includes a pair of ramped retaining projections 102 and 104 extending from either end. The ramped retaining projections 102 and 104 contain lower insertion ramp surfaces 101 and 105 that respectively define a normal directed generally downward and away from the lamp 120. The ramped retaining projections 102 and 104 also contain upper locking ramp surfaces 103 and 107 that respectively define a normal which is directed generally upwards and towards the lamp 120. With respect to the horizontal, the normal on each of the lower ramped surfaces 101 and 105 are of a lower angle than the normals of the upper locking ramp surface 103 and 107 so as to interact and cause horizontal movement of the retaining means located in the socket 200 with different degrees of resistance.

Chamfered edges 108 run along the major length dimension of the upper portion of the wedge base element 100 so as to provide a low resistance entry profile to the socket 200. In addition, a sloped surface 109 is located on either side of the wedge base element 100 and functions, in conjunction with a stop 220 within the socket 200, so as to limited the downward positioning of the wedge base in the socket.

The socket 200 contains a generally rectangular opening 206 that corresponds to the generally rectangular cross-section profile of the wedge base element 100 and extends down into a socket cavity. A pair of vertical slots 202 and 204 are disclosed at either end of the opening 206 so as to allow the ramped projections 102 and 104 to enter into the opening 206. Below the opening 206, a pair of slotted openings 212 and 214 extend transverse to respective slots 202 and 204. The slotted openings 212 and 214 contain converging sidewalls having a function that is explained below.

A spring wire 210 is mounted externally of the unitary socket 200 and has a generally rectangular "C" shape. The spring wire 210 is bent so as to have four corners and an opening defined between its ends 209 and 211. The spring wire 210 is mounted on the socket 200 in slot openings 212 and 214. The portions of the spring wire 210 that are within the slot openings 212 and 214 extend transverse to the slots 202 and 204 so as to interfere with the insertion of the wedge base element 100 by contacting the lower ramp surfaces 101 and 105 of the respective ramped projections 102 and 104. By utilizing a spring wire 210 that remains preload biased to provide a constant inward force, the insertion of the wedge base 100 into the socket opening 206 will cause the lower ramp surfaces 101 and 105 to contact the transversing portions between ends 209 and 211 of the wire 210 and move them in outward directions. During the last few millimeters prior to being fully inserted, the biased spring wire 210 contracts along the upper locking ramp surfaces 103 and 107 of the respective ramp projections 102 and 104 to hold the wedge base securely in the socket. When the lamp wedge base element 100 is fully insertion into the socket, the angled stops 220 on either side of the socket cavity contact the sloped surfaces 109 to limit its downward movement.

Since the normals of the upper locking ramp surfaces 103 and 107 are at higher angles with respect to a horizontal line joining the projections, the frictional resistance to lamp removal is greater than the insertion resistance. As such, the lamp is positively retained but may be removed by applying a strong pulling pressure.

The slotted openings 212 and 214 contain converging sidewalls that interact with the upper and lower ramp surfaces of the ramped projections 102 and 104 so as to contribute outwardly directed vector forces which in turn cause the contacted portions of spring 210 to be moved outwardly.

Electrical contact terminals 304 and 308 are inserted from the back side of the socket and locked in position by cantilever tabs 226 and 227 which lock into apertures formed in the terminals. Box like housings 217 and 216 provide service tool access to the respective electrical terminals 304 and 308 for release of the cantilever tabs and removal of the terminals. The terminals 304 and 308 provide compressive contact with respective filament lead wires 126 and 124.

A third electrical terminal 306 is retained by a tab 224 so that its respectively common contact elements 306A and 306B will come into electrical contact with respective filament lead wires 128 and 122 to provide common grounding for the dual filaments of the lamp 120.

Electrical wires 310, 312 and 314 are crimped to respective electrical terminals 306, 308 and 304 and are lead out through the bottom of the socket. A sealing cap 245 is attached to the base of the socket so as to prevent dirt and other contaminants from entering into the socket and also provides an opening for routing the wires for external connection.

The base of the socket 200 contains a flange 240 which defines a circumferential lip that, when installed in a reflector assembly 400 provides a seal against a gasket 250. Ramped keys 230 and 234 mate with keyways in the aperture of the reflector assembly 400 and provide a locking mechanism for the socket within the reflector assembly in an conventional manner through the use of ramping surfaces 232 and 236.

It can be seen that a major advantage of the present invention is that the wedge base element 100 and the socket opening 206 are symmetrical. Therefore, the lamp does not require a single orientation prior to insertion. Even with a dual filament lamp, such as that shown in the drawings, the correct filament will be contacted by an appropriate electrical terminal no matter which way the lamp is inserted into the socket Similarly, the retaining mechanism will grip the lamp wedge base 100 and retain it in position, irrespective of the orientation of the lamp.

It will be apparent that many modifications and variations may be implemented without departing from the scope of the novel concept of this invention. Therefore, it is intended by the appended claims to cover all such modifications and variations which fall within the true spirit and scope of the invention.

I claim:

1. A lamp socket for mating with and retaining a generally rectangular cross-sectional base of an incandescent lamp, wherein the lamp base has filament wire leads separately positioned and exposed on its outer side surfaces and ramped retaining projections on its end surfaces, comprising:

a unitary molded body defining a socket cavity and having a generally rectangular opening for slideably accepting the base of said incandescent lamp into said socket cavity;

a plurality of electrical terminals within said body for compressibly contacting said exposed filament wire leads of said lamp against said base when mated in said socket; and means protruding into said socket cavity so as to contact and compress against the upper portion of said ramped retaining projections at the ends of said base for removably holding said base tightly within said socket.

2. A socket as in claim 1, where in said holding means is a single piece of spring wire supported on said body and preloaded with sufficient bias to provide a relatively high level of resistance to the removal of said lamp base from said socket.

3. A socket as in claim 2, wherein said spring wire is bent into a generally rectangular configuration defining four corners and one open side.

4. A lamp socket for accepting a lamp having an insulated base attached thereto with a rectangular cross-sectional configuration and a pair of retaining projections extending from the relatively narrow end walls of said base;

said socket contains an opening configured to accept the lamp base and said retaining projections extending therefrom and includes means below the opening of said socket for providing a frictional force against said retaining projections when said lamp base is fully inserted into said socket opening for securely retaining said lamp in said socket.

* * * * *